United States Patent [19]

Dias, II

[11] 4,340,887

[45] Jul. 20, 1982

[54] PUSHBUTTON DATA ENTRY AND DISPLAY SYSTEM

[75] Inventor: Francis F. Dias, II, San Jose, Calif.

[73] Assignee: National Semiconductor Corporation, Santa Clara, Calif.

[21] Appl. No.: 115,145

[22] Filed: Jan. 24, 1980

[51] Int. Cl.[3] ..... G09G 3/00

[52] U.S. Cl. ..... 340/711; 340/365 R; 340/706

[58] Field of Search ..... 340/706, 711, 365 R

[56] References Cited

U.S. PATENT DOCUMENTS

| | | | |
|---|---|---|---|
| 1,054,336 | 2/1913 | Brown | 340/711 |
| 4,185,281 | 1/1980 | Silverstone | 340/706 |
| 4,202,038 | 5/1980 | Peterson | 340/365 R |

OTHER PUBLICATIONS

*Predetermining Counter Uses Microprocessor;* Instruments and Control Systems; 10/78; p. 92.

*Primary Examiner*—Marshall M. Curtis
*Attorney, Agent, or Firm*—Brown and Martin

[57] ABSTRACT

Disclosed is a data entry and display system for loading any one of N digits into any position of an M position data bus where N and M are integers. The system includes a set of N pushbutton switches each of which is representative of one of the digits; and a set of M pushbutton switches each of which corresponds to one of the M positions on the data bus. The system is operated simply by first pushing one of the N pushbutton switches which corresponds to the digits to be loaded; and by subsequently pushing one of the M pushbutton switches which corresponds to the desired digit position. This sequence is repeated for each digit to be loaded. A total of M identical circuits, one circuit for each digit positions in the data bus, operate in parallel to sense the pressed pushbuttons and to take the appropriate bus loading and bus displaying action.

1 Claim, 4 Drawing Figures

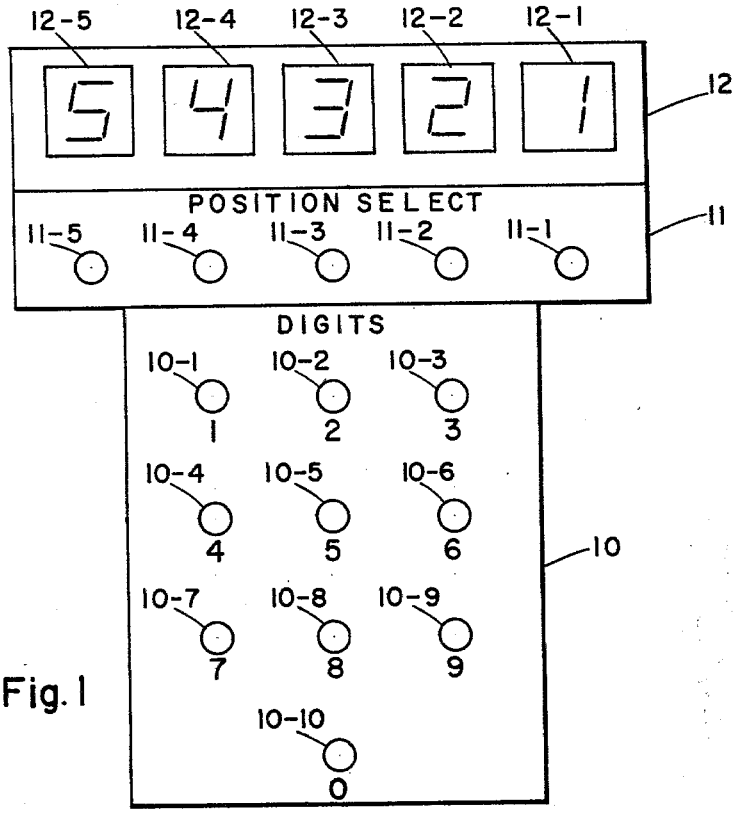
Fig. 1
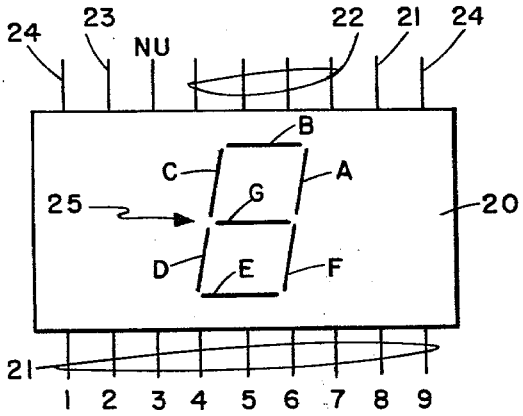
Fig. 2
| IN | OUTPUT BUS | LED DRIVE |
|---|---|---|
| 0 | 0000 | ABCDEF |
| 1 | 0001 | AF |
| 2 | 0010 | ABDEG |
| 3 | 0011 | ABEFG |
| 4 | 0100 | ACFG |
| 5 | 0101 | BCEFG |
| 6 | 0110 | BCDEFG |
| 7 | 0111 | ABF |
| 8 | 1000 | ABCDEFG |
| 9 | 1001 | ABCEFG |
| A | 1010 | ABCDFG |
| B | 1011 | CDEFG |
| C | 1100 | BCDE |
| D | 1101 | ADEFG |
| E | 1110 | BCDEG |
| F | 1111 | BCDG |
Fig. 4

PUSHBUTTON DATA ENTRY AND DISPLAY SYSTEM

BACKGROUND OF THE INVENTION

This invention relates to control panels and the like for entering data by hand into digital equipment such as a digital processor. In the past, these mechanisms have included a wide variety of switches such as pushbutton switches, alternate action switches, and thumbwheel switches. Generally, the type of switch that is used depends upon the function that it is to perform.

For example, a plurality of thumbwheel switches are frequently used in conjunction with a single pushbutton switch to enter data such as numbers, addresses or commands. This is achieved by first selecting the data to be entered via the thumbwheel switches and then depressing the single pushbutton. If the data can be sent to more than one place, then another thumbwheel switch is often used in conjunction with the above described combination to select the data's destination.

One problem however, with the above described data entry mechanism is that the thumbwheel switches are relatively unreliable. This is because they have moving parts which tend to wear, corrode, and otherwise make poor electrical contact with use. As a result the reliability of these switches is substantially less than other electronic components that they are typically used with, such as integrated circuit chips.

Another problem with the mechanical thumbwheel switches is that they are relatively expensive as compared to the price of the integrated circuit chips. For example, a typical thumbwheel switch may cost three times as much as a typical logic chip. Thus, systems which presently use a large number of thumbwheel switches could achieve a substantial price reduction if the thumbwheel switches could be replaced with the circuit chips.

Therefore, it is one object of the invention to provide an electronic circuit that can replace thumbwheel switches.

Another object of the invention is to provide a data entry and display system that utilizes no thumbwheel switches.

BRIEF SUMMARY OF THE INVENTION

These and other objects are accomplished in accordance with the invention by an electronic circuit that includes an encoding means, a first storage means, a second storage means, and a decoder means. The circuit is packaged on a single semiconductor chip. Only one of these circuits is required for each of the thumbwheel switches that is to be replaced.

A data entry system which uses the chip also includes a set of N pushbutton switches, each of which is representative of one of the digits to be entered onto a data bus; and a set of M pushbutton switches, each of which corresponds to one of the positions on the bus. Digits are entered onto the bus simply by first pushing one of the N pushbutton switches. All of these N switches are coupled to the encoding means in each of the chips. These encoding means operate to generate the digital code corresponding to the number represented by the pressed pushbutton. This code is then automatically stored within each chip by the first storage means.

To transfer this code from the first storage means onto the data bus, one of the M pushbutton switches is pushed. Each of these pushbutton switches connects respectively to only one of the M chips. The chip which senses an M pushbutton being pressed transfers the code from the first storage means to the second storage means. And the output of the second storage means in each chip forms one digit position of the data bus. The contents of the second storage means is then indicated via an electro-optic display, which is driven by the decoder means.

BRIEF DESCRIPTION OF THE DRAWINGS

The preferred embodiments of the invention are illustrated in the accompanying drawings wherein:

FIG. 1 is a pictorial view of a data entry and display system constructed according to the invention.

FIG. 2 is a plan view of one of the novel semiconductor chips within the data entry and display system of FIG. 1.

FIG. 4 is a truth table describing the operation of a portion of the FIG. 3 circuit and a variation thereof.

DETAILED DESCRIPTION

Figure 3:
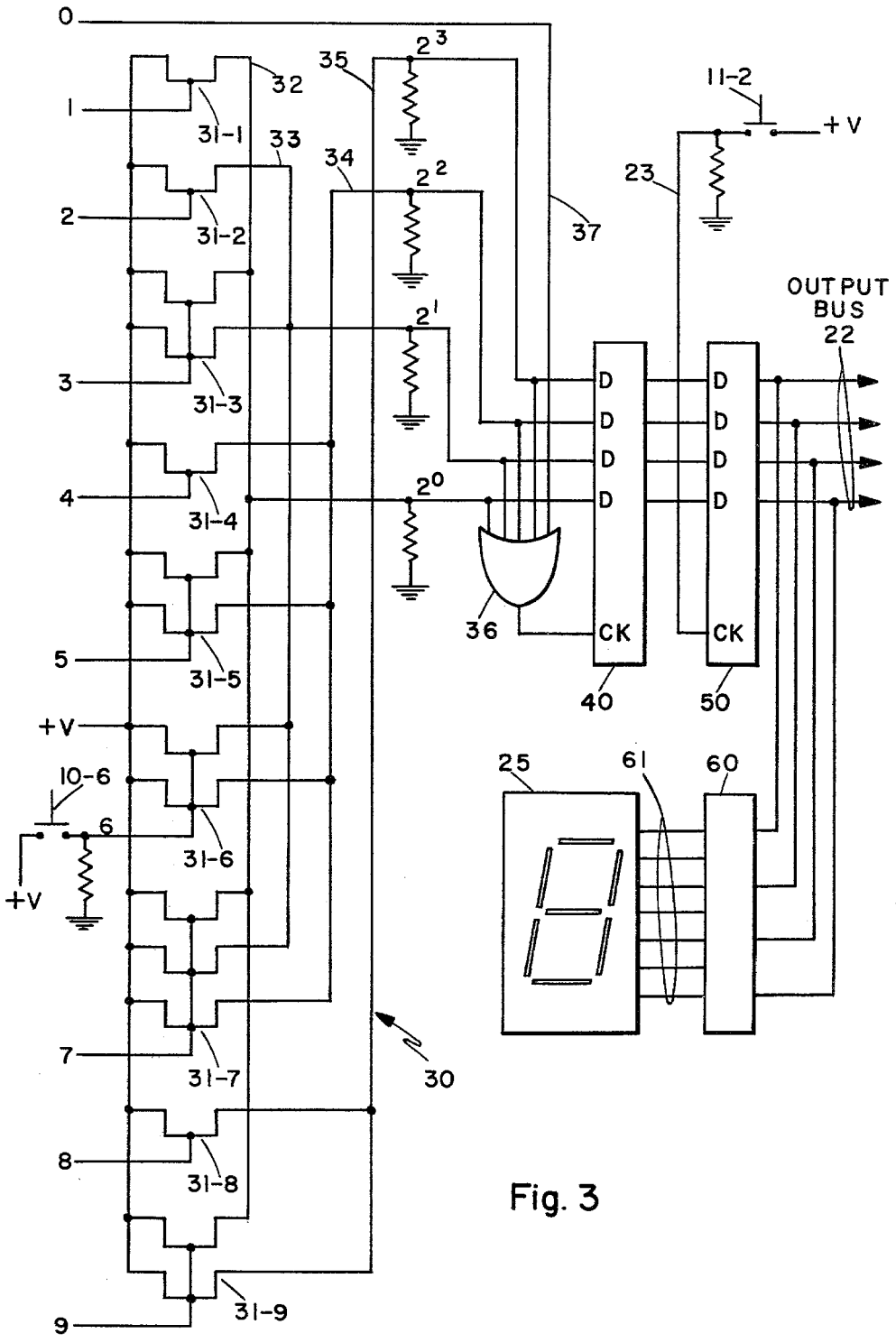
FIG. 3 is a detailed circuit diagram of the FIG. 2 semiconductor chip.

A preferred embodiment of a data entry and display system that is constructed according to the invention will now be described in detail in conjunction with the FIG. 1. That system includes a set of ten pushbutton switches 10-1 through 10-10. Each of these pushbutton switches represents one digit as indicated in the drawing. The system further includes a set of five pushbutton switches 11-1 through 11-5. Each of these switches select a particular position on the data bus to be loaded. In particular, switches 11-1 through 11-5 respectively select the units, tens, hundreds, thousands, and ten thousands position of the data bus.

Data is entered onto the data bus simply by first pushing one of the digit number keys 10-1 through 10-10, and by subsequently pushing one of the position select keys 11-1 through 11-5. This sequence is repeated for each digit that is to be entered. Thus, the operation of entering data is so simple that it can be performed by using a single finger.

Each of the digits which are entered are manifested by an electro-optic display 12. More specifically, the units through ten thousands position are respectively manifested by display elements 12-1 through 12-5. These displays are automatically updated when the position select switches 11 are pushed as described above.

Note that with the FIG. 1 system, data can be entered in any order. Thus, to enter the number of 54,321, an operator could first push key 10-5 followed by key 11-5 which would cause a 5 to be illuminated by element 12-5. Then he could push key 10-1 followed by key 11-1 which would cause a 1 to be illuminated by element 12-1. Also, if the data is to be changed from one setting to another, then only those digits which differ in the two settings need be changed. For example, to change the illustrated setting to 55,321, an operator need only push key 10-5 followed by key 11-4.

A total of five indentical circuits are included in the FIG. 1 system to respond to keys 10 and 11. Each of these circuits is packaged on a single semiconductor chip 20 as illustrated in FIG. 2. These chips operate in parallel independent of one another. Thus, an additional digit position can be added to the system simply by adding another one of the chips 20.

Chip 20 has eighteen pins. These are divided into groups 21 through 24. Group 21 contains 10 pins for respective connection to the digit switches 10-1 through 10-10. Group 22, in comparison, contains four pins. These are output pins which form one digit position of the bus. Signals on these pins are in binary coded decimal.

Group 23 contains only one pin. It is for connection to one of the position select pushbutton switches 11. When the signal on pin 23 indicates the pushing of that switch, the code on pins 22 is updated to indicate which of the digit pushbuttons was last depressed. This information is also manifested by an electro-optic display 25. The display forms one face of the chip package. Letters A-G indicate the various segments of the display. Power to operate the display and all other circuitry within chip 20 is provided via pins in group 24.

Referring now to FIG. 3, the contents of chip 20 is illustrated in greater detail. It includes an encoder 30, a pair of registers 40 and 50, a decoder 60, and display 25. Encoder 30 is basically comprised of a plurality of MOSFET transistors 31-1 through 31-9. Each of these transistors has a source connected to a voltage +V and a drain connected to one of four conductors 32 through 35. Due to the arrangement of the transistors 31-1 through 31-9, a binary coded decimal number which corresponds to the digit pushbutton that is being depressed, is formed in the conductors.

For example, when pushbutton 10-6 is pushed, the gates of transistors 31-6 are biased such that those transistors turn on. In response, conductors 33 and 34 go to voltage +V. At the same time, all of the other transistors are turned off, and thus conductors 32 and 35 remain at ground.

All of the conductors 32 through 35 are logically OR'd together via a gate 36. Signals on the pin which connects to the 0 digit switch are also OR'd via this gate, as indicated via reference numeral 37. The output of gate 36 clocks register 40. Thus, whenever any of the digit switches are pressed, a binary coded decimal representation of the pressed switch is stored in register 40.

The above storing action occurs in every one of the chips 20 that is in the display system. For example, in the illustrated five position display systems, register 40 in each of the five chips will store the number corresponding to the pressed digit pushbuttons 10. The data in register 40, however, is only selectively transferred to register 50. The chip in which this transfer occurs is selected by the position select pushbuttons 11. In FIG. 3, the chip is illustrated as being connected to position select pushbutton 11-2. Thus, depressing button 11-2 will cause a low to high voltage transition on pin 23, which in turn will clock data from register 40 into register 50.

Register 50 forms one digit position of the data bus. Pins 22 provide a means for connecting the bus to various points in the equipment that uses the data entry system. The output of register 50 also connects to a decoder 60. This decoder operates to generate segment display signals on leads 61 for the electrooptic display 25. The decoding is performed in a manner similar to that previously described in conjunction with encoder 30. A truth table describing the decoding operation is given in FIG. 4.

A second embodiment of the invention which is substantially similar to that embodiment described above is also indicated in FIG. 4. The second embodiment has a total of sixteen input pins instead of ten, so that it can receive hexi-decimal inputs. These are indicated via the numbers 0 through 9 and A through F in FIG. 4. Also therein illustrated are the corresponding display segments which must be eliminated by decoder 60.

The second embodiment is physically packaged in a manner similar to that illustrated in FIG. 2. However, due to the additional input pins that are required, the second embodiment is packaged in a twenty-four pin chip as opposed to an eighteen pin chip. In either case, the amount of circuitry that is involved is relatively small and can readily be fit on a die size no larger than a medium scale integrated circuit.

Two preferred embodiments of the invention have now been described in detail. In addition, many changes and modifications may be made to these details without departing from the nature and spirit of the invention. For example with reference to FIG. 3, it should be apparent that encoder 30 and register 40 may be interchanged. That is, all of the signals on pins 21 could first be stored in register 40; and subseqently encoded into BCD. As another alternative, registers 40 and 50 could both precede encoder 30. Therefore, it is to be understood that the invention is not limited to the above described details, but is defined by the appended claims.

I claim:

1. A data entry and display system for loading any one of N digits into any position on an M digit data bus for transmission to a digital processor where N and M are integers, said system being comprised of:

a set of N pushbutton switches each of which is representative of one of said digits;

a set of M pushbutton switches; each of which corresponds to one of said M digit positions; and a set of M identical circuits operating in parallel, each of the circuits including:

an encoder including a plurality of FET transistors and a plurality of encoder output conductors, the transistors having sources connected to a voltage +V, gates selectively connectable to the voltage +V through the depressing of corresponding ones of the N pushbutton switches, and drains connected to corresponding ones of the encoder output conductors so that a digital code will be generated on the encoder output conductors corresponding to the number represented by the depressed one of the N pushbutton switches, a first data storage register having a plurality of input terminals, a plurality of output terminals and a clock terminal, the input terminals being connected to corresponding ones of the encoder output terminals, an OR gate having inputs connected to the encoder output terminals and an output connected to the clock terminal of the first register so that a signal on the output of the OR gate will cause the digital code generated on the encoder output conductors to be stored in the first register, a second data storage register having a plurality of input terminals, a plurality of output terminals and a clock terminal, the output terminals of the first register being connected to the input terminals of the second register for storing therein the contents of the first register in response to the depressing of one of the M pushbutton switches connected to the clock terminal of the second register, means for connecting the output terminals of the second register to the M digit data bus, a decoder having a plurality of input terminals connected to the output terminals of the second register for generating on a plurality of output terminals segment display signals representative of the number of the depressed one of the N pushbutton switches, and an electro-optic display element having a plurality of input terminals connected to the output terminals of the decoder for receiving the segment display signals and displaying the number of the depressed one of the N pushbutton switches.

* * * * *